US009553396B1

(12) United States Patent
Yang et al.

(10) Patent No.: US 9,553,396 B1
(45) Date of Patent: Jan. 24, 2017

(54) ANTI-ROTATION SEAL FOR CONNECTOR ASSEMBLY

(71) Applicant: Yazaki North America, Inc., Canton, MI (US)

(72) Inventors: Eugene Yang, Ypsilanti, MI (US); Jen Vun Ng, Westland, MI (US); Kevin Shaheen Pakravan, Ann Arbor, MI (US)

(73) Assignee: YAZAKI NORTH AMERICA, INC., Canton, MI (US)

( * ) Notice: Subject to any disclaimer, the term of this patent is extended or adjusted under 35 U.S.C. 154(b) by 0 days.

(21) Appl. No.: 14/937,443

(22) Filed: Nov. 10, 2015

(51) Int. Cl.
*H01R 13/52* (2006.01)

(52) U.S. Cl.
CPC ..... *H01R 13/5202* (2013.01)

(58) Field of Classification Search
CPC ..... H01R 13/5219; H01R 13/5221; H01R 13/5208; H01R 13/562; H01R 33/00; H01R 13/5202
USPC ..... 439/271–275, 278, 548, 556, 559, 587
See application file for complete search history.

(56) References Cited

U.S. PATENT DOCUMENTS 4,095,808 A 6/1978 Glasson
4,611,872 A * 9/1986 Ito ..... H01R 13/5219 439/277
4,684,190 A 8/1987 Clark
4,820,181 A * 4/1989 Kuzuno ..... H01R 13/5219 439/272
4,874,325 A 10/1989 Bensing
4,917,620 A * 4/1990 Samejima ..... H01R 13/5219 439/271
5,158,391 A * 10/1992 Fujitani ..... H01R 13/5202 277/615
5,173,024 A 12/1992 Mouchel
5,236,302 A 8/1993 Weisgerber
5,320,488 A 6/1994 Meade
5,336,102 A 8/1994 Cairns
5,492,487 A 2/1996 Cairns
5,613,868 A * 3/1997 Ohsumi ..... H01R 13/5221 439/275
5,651,689 A 7/1997 Plyler
6,106,234 A 8/2000 Gabbitas
6,422,899 B1 * 7/2002 Miyazaki ..... H01R 13/748 439/271
6,517,368 B2 * 2/2003 Hara ..... H01R 13/521 439/271
6,702,593 B2 3/2004 Ogawa
(Continued)

*Primary Examiner* — Thanh Tam Le
(74) *Attorney, Agent, or Firm* — Remarck Law Group PLC

(57) ABSTRACT

An interface seal for an electrical connector assembly that includes a housing and a seal retainer defining a seal recess and configured to couple to the housing, is disclosed. The interface seal includes a main body portion configured to substantially surround the housing to create a sealing interface, and an anti-rotation projection coupled to and extending from the main body portion. The anti-rotation projection includes (i) an engagement portion extending in a first direction and (ii) a connecting portion that couples the engagement portion with the main body portion and that extends in a second direction different from the first direction. The anti-rotation projection cooperates with the seal recess to inhibit movement of the interface seal with respect to the housing and seal retainer.

15 Claims, 5 Drawing Sheets

(56) References Cited

U.S. PATENT DOCUMENTS

| | | | | |
|---|---|---|---|---|
| 6,814,599 | B2 * | 11/2004 | Sakiyama | H01R 13/5219 439/271 |
| 6,953,357 | B2 * | 10/2005 | Fukushima | H01R 13/5219 439/271 |
| 7,329,145 | B2 * | 2/2008 | Yagome | H01R 13/506 439/271 |
| 7,448,908 | B2 * | 11/2008 | Iwahori | H01R 13/5219 439/587 |
| 8,992,242 | B2 * | 3/2015 | Casses | H01R 13/5205 439/271 |
| 2014/0175755 | A1 | 6/2014 | Luchs | |

* cited by examiner

ANTI-ROTATION SEAL FOR CONNECTOR ASSEMBLY

FIELD

The present disclosure relates to connectors and, more particularly, to seals for electrical connectors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Electrical connectors may be used to connect a plurality of electrical wires to various different structures, including, but not limited to, a printed circuit board, another connector, or an electrical module. Typically, the electrical connectors have a first connector and a second connector which are coupled together. The first connector may include a plurality of pins or terminals which pass into the printed circuit board or module, and the second connector may have a plurality of electrical wires for connection with the pins.

An interface seal may be used for sealing a joint between the coupled connectors, however, some interface seals may be easily rotated if the seal is accidentally touched or pinched during handling and assembly. Accordingly, it is desirable to provide an interface seal with anti-rotation features.

SUMMARY

In various embodiments of the present disclosure, an interface seal for an electrical connector assembly that includes a housing and a seal retainer defining a seal recess and configured to couple to the housing, is disclosed. The interface seal includes a main body portion configured to substantially surround the housing to create a sealing interface, and an anti-rotation projection coupled to and extending from the main body portion. The anti-rotation projection includes an engagement portion extending in a first direction. The anti-rotation projection cooperates with the seal recess to inhibit movement of the interface seal with respect to the housing and seal retainer.

In various embodiments of the present disclosure, a connector assembly is disclosed. The connector assembly includes a housing, a seal retainer coupled with the housing and defining a seal recess, and an interface seal arranged between the housing and seal retainer. The interface seal includes a main body portion that substantially surrounds the housing to provide a sealing interface, and an anti-rotation projection coupled to and extending from the main body portion. The anti-rotation projection is at least partially arranged within the seal recess and includes an engagement portion extending in a first direction. The anti-rotation projection cooperates with the seal recess to inhibit movement of the interface seal with respect to the housing and seal retainer.

In various embodiments of the present disclosure, an electrical connector assembly is disclosed. The electrical connector assembly includes a first connector assembly, a second connector assembly, and an interface seal. The first connector assembly includes a housing, a seal retainer coupled with the housing and defining a seal recess, and a first set of electrical terminals. The second connector assembly is coupled to the first connector assembly and includes a second set of electrical terminals in electrical communication with the first set of electrical terminals. The interface seal is arranged between the first and second connector assembly and includes a main body portion configured to substantially surround the first connector housing to provide a sealing interface, and an anti-rotation projection coupled to and extending from the main body portion. The anti-rotation projection includes an engagement portion extending in a first direction. The anti-rotation projection cooperates with the seal recess to inhibit movement of the interface seal with respect to the housing and seal retainer.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
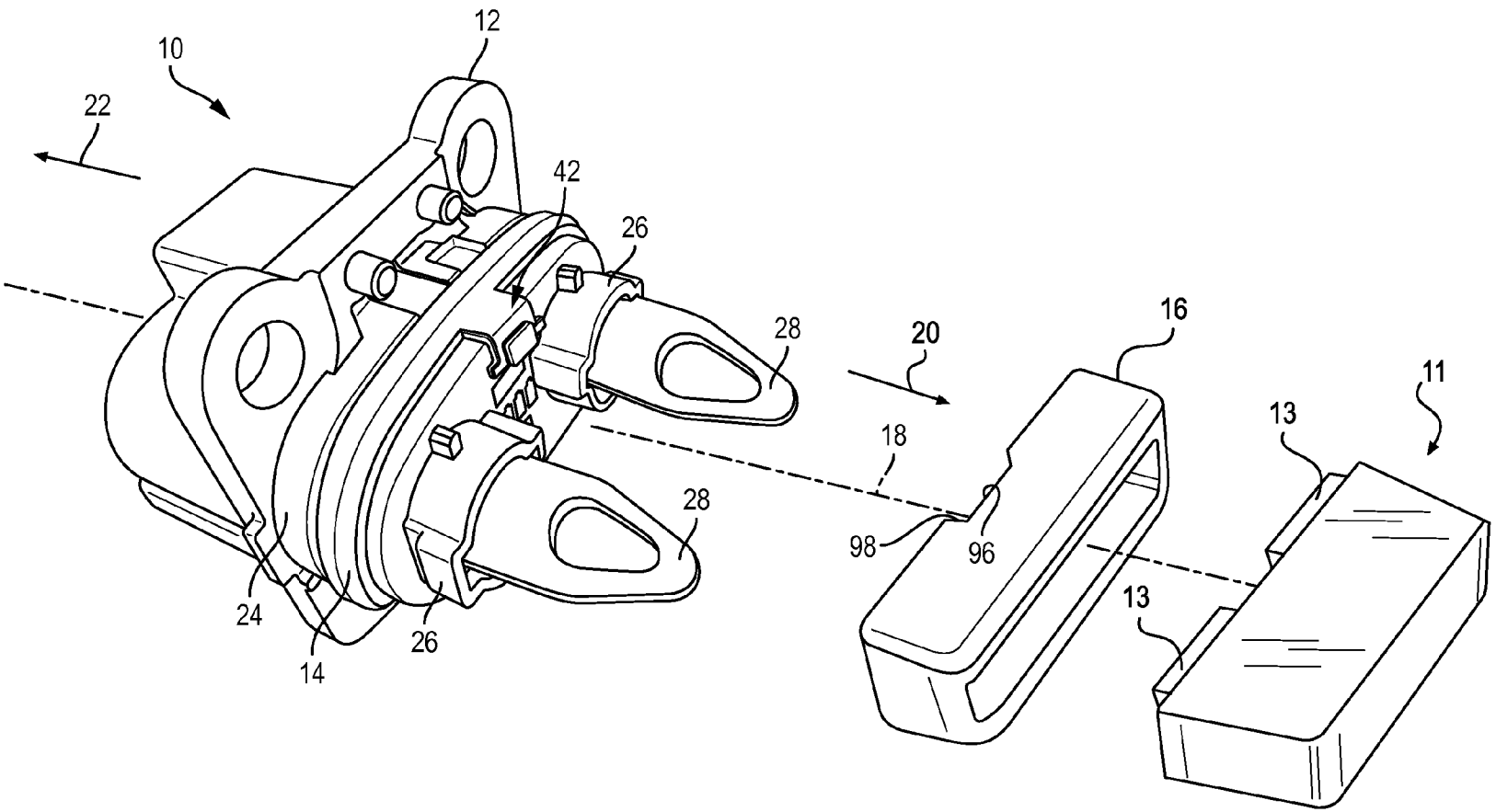
FIG. 1 is a perspective view of an example connector assembly that includes an interface seal according to some implementations of the present disclosure.

FIG. 1 illustrates an example electrical connector assembly 10 that generally includes a housing 12, an interface seal 14, and a seal retainer or cover 16. Electrical connector assembly 10 is configured to couple to an electrical component such as another connector, a printed circuit board, or electrical wires (not shown). In some embodiments, electrical connector assembly 10 is configured as an electrical connector assembly for a vehicle (not shown), however, connector assembly 10, and in particular interface seal 14, may be used in various other systems and components such as a header for a module.

In the illustrated embodiment, housing 12 can be a one-piece structure formed from a rigid material chosen to be resilient in environments of high temperature and/or chemical exposure (e.g., metal or plastic). Housing 12 extends along a mating or longitudinal axis 18, which is the axis along which connector assembly 10 can move to mate with one or more other connectors or connector assemblies, such as connector assembly 11 having a set of electrical terminals 13. In the illustrated embodiment, a mating direction 20 is along mating axis 18 and may be the direction connector assembly 10 moves relative to one or more other connectors or connector assemblies when interconnecting. A disengaging direction 22 is along mating axis 18 and is opposite to mating direction 20, and disengaging direction 22 can be the direction connector assembly 10 moves relative to one or more other connectors or connector assemblies when separating.

Figure 4:
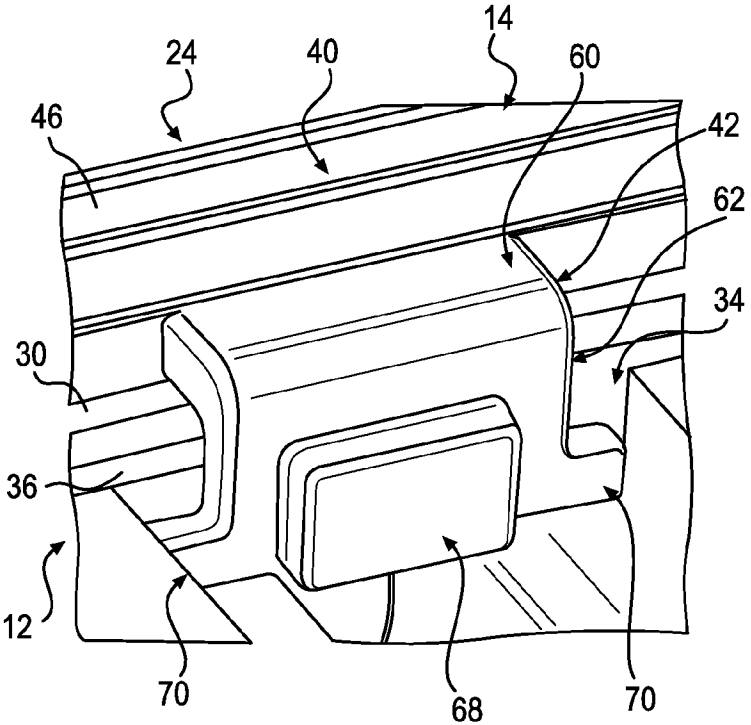
FIG. 4 is another enlarged perspective view of the interface seal and connector assembly of FIG. 1.
Figure 6:
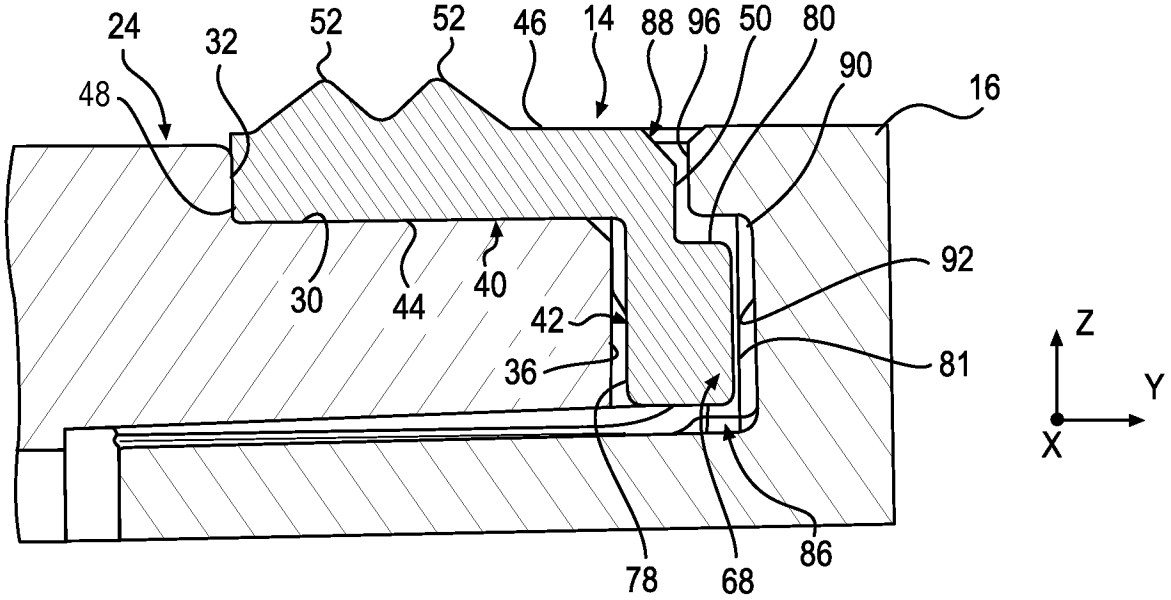
FIG. 6 is a cross-sectional view of the connector assembly shown in FIG. 5 and taken along line 6-6.

In the illustrated embodiment, housing 12 includes an outer support surface 24 and a plurality of cavities 26 each configured to house one or more electrical wires, terminals or other type of connections 28. As shown in FIGS. 4 and 6, support surface 24 defines a seal receiving surface 30, a seal engagement shoulder 32, an anti-rotation feature aperture 34 (FIG. 4), and an anti-rotation feature engagement surface 36.

Figure 3:
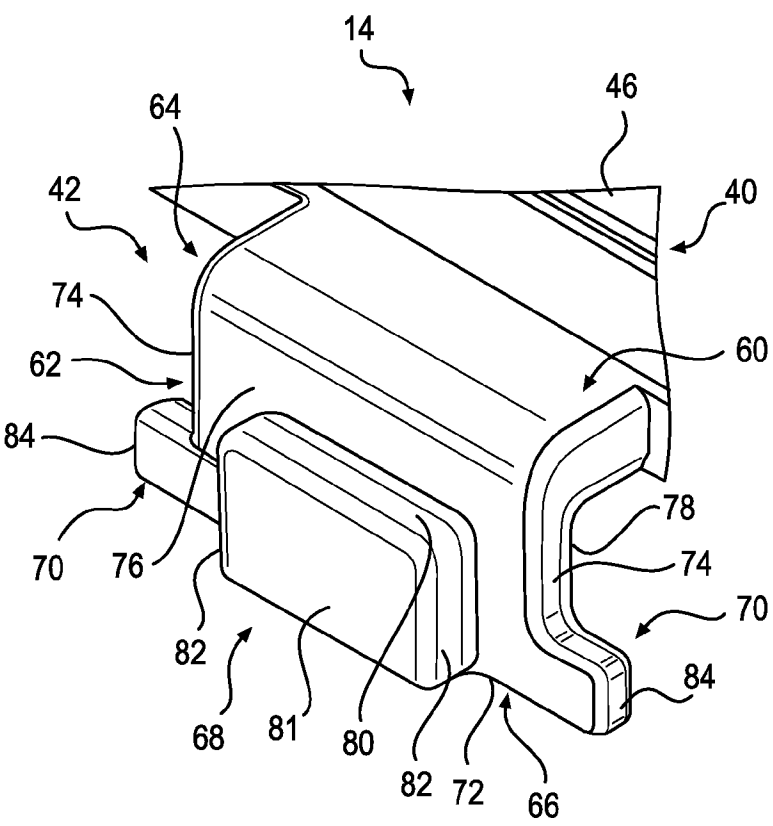
FIG. 3 is an enlarged perspective view of the interface seal shown in FIG. 2.
Figure 2:
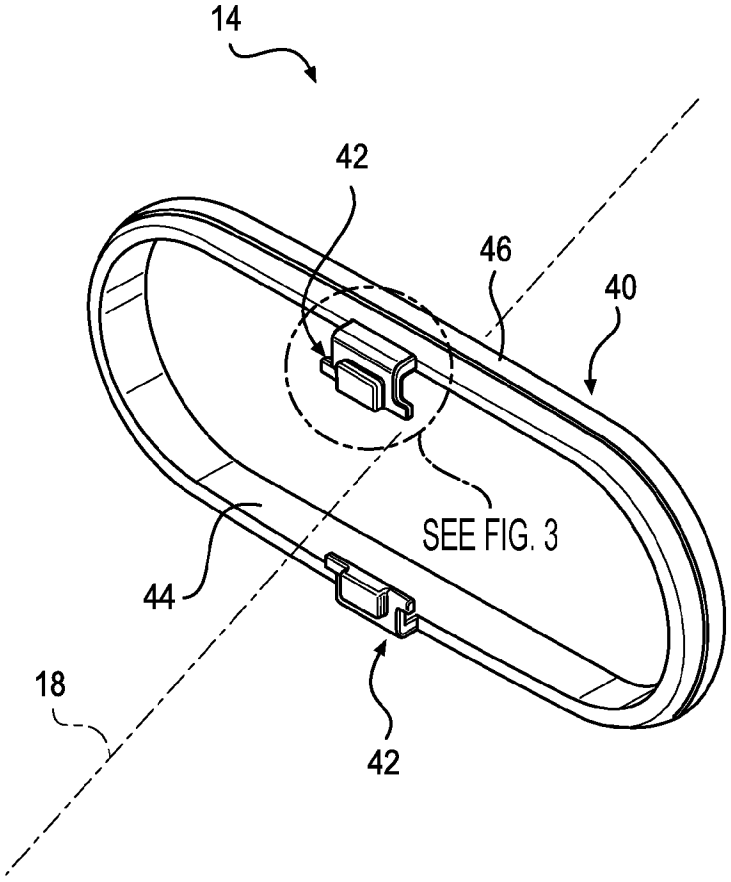
FIG. 2 is a perspective view of the example interface seal of FIG. 1.

With reference to FIGS. 2 and 3, interface seal 14 can generally include a main body portion 40 and one or more anti-rotation projections 42 extending therefrom. Interface seal 14 is configured to facilitate a sealing arrangement between connector assembly 10 and one or more other connectors or connector assemblies. Anti-rotation projection(s) 42 is (are) configured to inhibit sliding, rotating, or extraction of interface seal 14 to thereby retain the seal in an assembled position on housing 12.

As illustrated in FIG. 2, interface seal 14 is generally track-shaped. However, interface seal 14 may have any suitable shape that enables the interface seal to be utilized with various shaped connector assemblies. For example, interface seal 14 may be circular or rectangular. In the illustrated embodiment, interface seal 14 includes two anti-rotation projections 42 disposed approximately on opposite sides of interface seal 14, however, interface seal 14 may have any suitable number of anti-rotation features (e.g., one or three) in various positions about a periphery or edge of interface seal 14. Interface seal 14 can be fabricated from any suitable material that enables the interface seal 14 to create a sealing interface and otherwise function as described herein, such as an elastomeric material, rubber, plastic, and the like.

With further reference to FIG. 6, interface seal main body portion 40 includes an inner surface 44, an outer surface 46, a first edge 48, and an opposite, second edge 50. Inner surface 44 is configured to be disposed on or along seal receiving surface 30 of housing 12. In the illustrated embodiment, seal 14 is sized equal to or slightly smaller than seal receiving surface 30 such that inner surface 44 frictionally engages surface 30 or otherwise creates an interference fit with the housing 12 and/or seal retainer 16. Outer surface 46 includes a plurality of bumps or ribs 52 extending radially outward therefrom that are configured, e.g., to provide a sealing interface and/or additional frictional engagement with another connector assembly such as assembly 11. Additionally or alternatively, other surfaces such as inner surface 44 may include one or more bumps or ribs (not shown). First edge 48 engages or is disposed in proximity to seal engagement shoulder 32 of housing 12.

With further reference to FIG. 3, the example interface seal anti-rotation projection 42 can include a connecting portion 60 and an engagement portion 62. Connecting portion 60 is coupled between main body portion second edge 50 and engagement portion 62 and extends parallel to or substantially parallel to seal main body portion 40 and axis 18 in mating direction 20. In other embodiments, engagement portion 62 is directly coupled to seal main body portion 40 such that the interface seal anti-rotation projection 42 does not include a connecting portion 60 as shown.

Engagement portion 62 generally includes a proximal end 64, a distal end 66, a first anti-rotation member or tab 68, and second anti-rotation members or hooks 70. Proximal end 64 is coupled to connecting portion 60 such that engagement portion 62 extends perpendicular to or generally perpendicular to seal main body portion 40 and axis 18. Engagement portion 62 further defines an end surface 72, side surfaces 74, an outer surface 76, and an inner surface 78. As shown in FIG. 6, inner surface 78 engages or is disposed in proximity to anti-rotation feature engagement surface 36.

As illustrated in FIGS. 3 and 4, anti-rotation tab 68 has a generally rectangular cross-section and extends outwardly from engagement portion outer surface 76 in a direction parallel to or substantially parallel to mating direction 20. Anti-rotation tab 68 defines an upper engagement surface 80, an outer engagement surface 81, and side engagement surfaces 82 configured to engage cover 16, as described herein in more detail. In other embodiments, tab 68 may have any suitable cross-sectional shape that enables anti-rotation tabs 68 to function as described herein. For example, anti-rotation tabs 68 may have a circular or triangular cross-sectional shape.

Anti-rotation hooks 70 have a generally rectangular cross-section and extend outwardly from engagement portion side surfaces 74 parallel to or substantially parallel to seal main body portion 40 and orthogonal to or substantially orthogonal to axis 18. Anti-rotation hooks 70 each define a side engagement surface 84 configured to engage cover 16, as described herein in more detail. In other embodiments, hooks 70 may have any suitable cross-sectional shape that enables anti-rotation hooks 70 to function as describe herein. For example, anti-rotation hooks 70 may have a circular or triangular cross-sectional shape.

Figure 5:
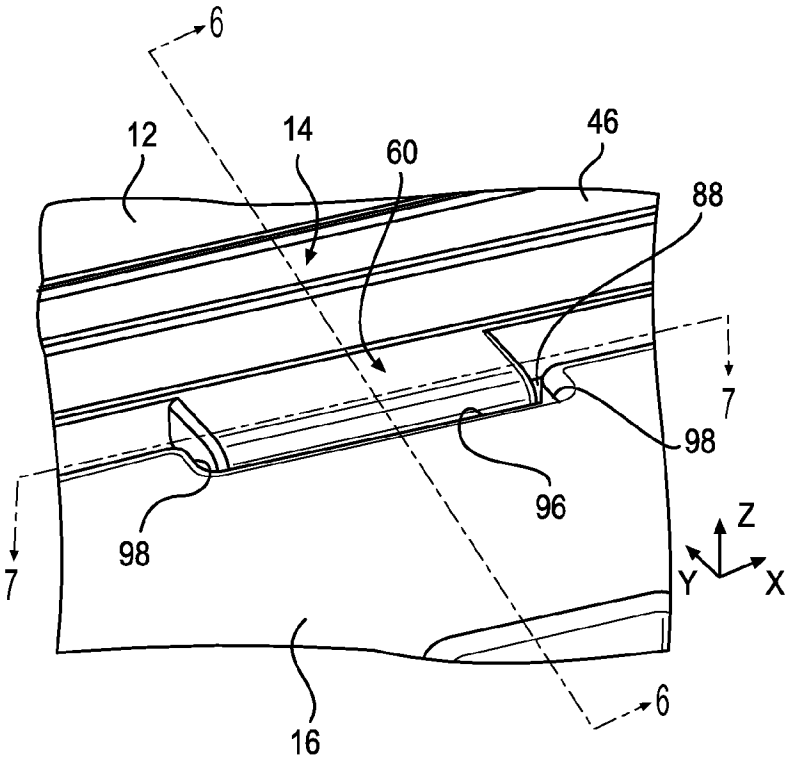
FIG. 5 is yet another perspective view of the interface seal and connector assembly of FIG. 1.
Figure 7:
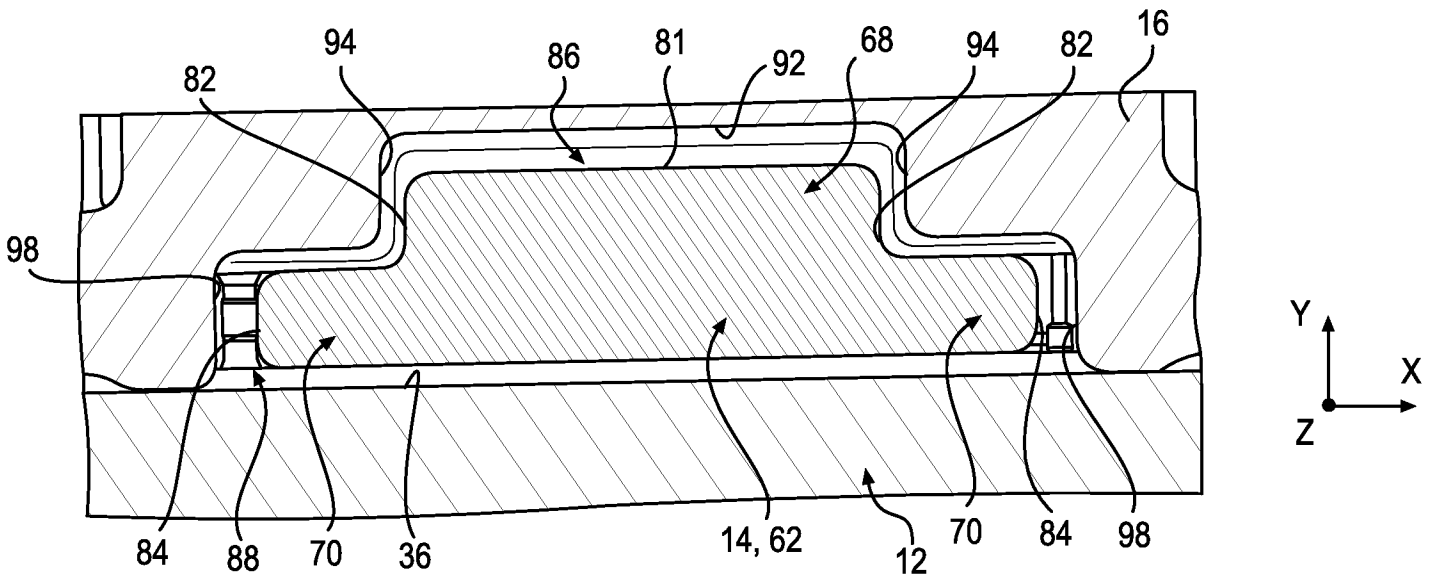
FIG. 7 is a cross-sectional view of the connector assembly shown in FIG. 5 and taken along line 7-7.

With reference to FIGS. 5-7, seal retainer or cover 16 is configured to releasably couple to housing 12 such that the interface seal 14 is arranged between the housing 12 and the seal retainer 16. Seal retainer 16 includes a first seal recess 86 and a second seal recess 88 formed therein, which are disposed proximate housing 12 and configured to receive at least a portion of interface seal engagement portion 62. In other embodiments, cover 16 and housing 12 may be non-releasably coupled.

First seal recess 86 is at least partially defined by an upper engagement wall 90 (FIG. 6), an inner engagement wall 92, and side engagement walls 94 (FIG. 7). Second seal recess 88 is connected and disposed adjacent to first seal recess 86, as best shown in FIG. 7. Second seal recess 88 is at least partially defined by an upper inner wall 96 (FIGS. 5 and 6) and side engagement walls 98 (FIGS. 5 and 7).

In operation, interface seal 14 is disposed about housing 12 and positioned such that anti-rotation projections 42 are configured to engage housing 12 and/or cover 16 to inhibit rotation or other movements of interface seal 14. In particular, interface seal 14 is positioned about housing outer support surface 24 such that seal anti-rotation projection 42 is disposed at least partially within anti-rotation feature aperture 34 (see FIG. 4). As such, seal inner surface 44 frictionally engages or is in proximity to seal receiving surface 30, first edge 48 frictionally engages or is in proximity to seal engagement shoulder 32 (e.g., see FIG. 6), and engagement portion inner surface 78 frictionally engages or is in proximity to anti-rotation feature engagement surface 36.

Seal retainer or cover 16 is disposed within or about at least a portion of housing 12 and is positioned such that seal anti-rotation projection 42 is disposed at least partially within first seal recess 86 and second seal recess 88. As such, anti-rotation tab 68 is disposed at least partially within first seal recess 86 such that upper engagement surface 80 frictionally engages or is in proximity to upper engagement wall 90 (see FIG. 6), outer engagement surface 81 frictionally engages or is in proximity to inner engagement wall 92, and side engagement surfaces 82 frictionally engage or are in proximity to side engagement walls 94 (see FIG. 7).

Further, anti-rotation hooks 70 are disposed at least partially within second seal recess 88 such that side engagement surfaces 84 frictionally engage or are in proximity to side engagement walls 98 (see FIG. 7).

Accordingly, the assembly of housing 12, interface seal 14, and cover 16 inhibit rotation or movement of interface seal 14 in the orthogonal x, y, and z-directions (see FIGS. 5-7). In particular, side engagement walls 94, 98 are positioned and configured to respectively engage side engagement surfaces 82, 84 to inhibit movement of interface seal 14 in the +/−x-direction (see FIG. 7). Similarly, inner engagement wall 92 and anti-rotation feature engagement surface 36 are positioned and configured to respectively engage outer engagement surface 81 and inner surface 78 to inhibit movement of interface seal 14 in the +/−y-direction (see FIGS. 6 and 7). And as illustrated in FIG. 6, upper engagement wall 90 is positioned and configured to engage upper engagement surface to inhibit movement of interface seal in the z-direction.

Described herein are systems and methods for preventing multi-directional movement and/or rotation of an interface seal during handling and assembly. An electrical connector assembly includes a housing, an interface seal, and a seal retainer or cover. The interface seal is disposed on the housing and the cover holds the seal in place. The interface seal includes multi-directional anti-rotation projections such as tabs and hooks that facilitate preventing interface seal from sliding, rotating, or being extracted from (e.g., pulled out) from a seated position on the connector assembly housing. These features provide additional surface area contact with the cover, which creates additional frictional forces therebetween. Accordingly, the interface seal is held firmly in position and provides proper sealing performance by preventing accidental seal misalignment.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known procedures, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The term "and/or" includes any and all combinations of one or more of the associated listed items. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An interface seal for an electrical connector assembly that includes a housing and a seal retainer defining a seal recess and configured to couple to the housing, the interface seal comprising:

a main body portion configured to substantially surround the housing to create a sealing interface; and an anti-rotation projection coupled to and extending from the main body portion, the anti-rotation projection including an engagement portion extending in a first direction and comprising a tab and a plurality of hooks, wherein (i) the tab is configured to engage a first surface of the seal retainer and extends from the engagement portion in a second direction different from the first direction, (ii) the plurality of hooks is configured to engage a plurality of second surfaces different from the first surface, and (iii) at least one hook of the plurality of hooks extends in a third direction different from the first and second directions, wherein the anti-rotation projection cooperates with the seal recess to inhibit movement of the interface seal with respect to the housing and seal retainer.

2. The interface seal of claim 1, wherein the third direction is substantially orthogonal to the second direction.

3. The interface seal of claim 1, wherein the interface seal includes an outer surface having a plurality of ribs extending radially outward therefrom.

4. The interface seal of claim 1, wherein the anti-rotation projection further includes a connecting portion that couples the engagement portion with the main body portion and that extends in the second direction, wherein the second direction is substantially orthogonal to the first direction.

5. A connector assembly, comprising:

a housing;

a seal retainer coupled with the housing and defining a seal recess; and an interface seal arranged between the housing and seal retainer, the interface seal comprising:

a main body portion that substantially surrounds the housing to provide a sealing interface, and an anti-rotation projection coupled to and extending from the main body portion, the anti-rotation projection being at least partially arranged within the seal recess, the anti-rotation projection including an engagement portion extending in a first direction and comprising a tab and a plurality of hooks, wherein (i) the tab is configured to engage a first surface of the seal retainer and extends from the engagement portion in a second direction different from the first direction, (ii) the plurality of hooks is configured to engage a plurality of second surfaces different from the first surface, and (iii) at least one hook of the plurality of hooks extends in a third direction different from the first and second directions, wherein the anti-rotation projection cooperates with the seal recess to inhibit movement of the interface seal with respect to the housing and seal retainer.

6. The connector assembly of claim 5, wherein the third direction is substantially orthogonal to the second direction.

7. The connector assembly of claim 5, wherein the seal recess defines the first surface and the second surface.

8. The connector assembly of claim 5, wherein the anti-rotation projection cooperates with the seal recess to inhibit movement of the interface seal in at least two orthogonal directions.

9. The connector assembly of claim 5, wherein the anti-rotation projection cooperates with the seal recess to inhibit movement of the interface seal in three orthogonal directions.

10. The connector assembly of claim 5, wherein the interface seal includes an outer surface having a plurality of ribs extending radially outward therefrom.

11. The connector assembly of claim 5, wherein the anti-rotation projection further includes a connecting portion that couples the engagement portion with the main body portion and that extends in the second direction, and wherein the second direction is substantially orthogonal to the first direction.

12. An electrical connector assembly, comprising:

a first connector assembly comprising a housing, a seal retainer coupled with the housing and defining a seal recess, and a first set of electrical terminals;

a second connector assembly coupled to the first connector assembly and including a second set of electrical terminals in electrical communication with the first set of electrical terminals; and an interface seal arranged between the first and second connector assembly, the interface seal comprising:

a main body portion configured to substantially surround the first connector housing to provide a sealing interface; and an anti-rotation projection coupled to and extending from the main body portion, the anti-rotation projection including an engagement portion extending in a first direction and comprising: (i) a tab configured to engage a first surface of the seal recess, the tab extending from the engagement portion in a second direction substantially orthogonal to the first direction, and (ii) a plurality of hooks configured to engage a plurality of second surfaces of the seal recess different from the first surface, at least one hook of the plurality of hooks extending in a third direction different from the first and second directions, wherein the third direction is substantially orthogonal to both the first and second directions, wherein the anti-rotation projection cooperates with the seal recess to inhibit movement of the interface seal with respect to the housing and seal retainer.

13. The electrical connector assembly of claim 12, wherein the anti-rotation projection further includes a connecting portion that couples the engagement portion with the main body portion and that extends in the second direction.

14. The electrical connector assembly of claim 13, wherein the anti-rotation projection cooperates with the seal recess to inhibit movement of the interface seal in three orthogonal directions.

15. The electrical connector assembly of claim 13, wherein the interface seal includes an outer surface having a plurality of ribs extending radially outward therefrom.

* * * * *